US005749749A

United States Patent [19]

Gallone

[11] Patent Number: 5,749,749

[45] Date of Patent: May 12, 1998

[54] ELECTRIC LOW-VOLTAGE CONNECTING TERMINAL, IN PARTICULAR FOR LUMINOUS SIGNALLERS

[75] Inventor: Flavio Gallone, Cornaredo, Italy

[73] Assignee: Signal Lux S.p.A., Novara, Italy

[21] Appl. No.: 709,103

[22] Filed: Sep. 6, 1996

[30] Foreign Application Priority Data

Dec. 13, 1995 [EP] European Pat. Off. ..... 95830511

[51] Int. Cl.[6] ..... H01R 17/00

[52] U.S. Cl. ..... 439/617

[58] Field of Search ..... 439/346, 918, 439/617, 592, 595

[56] References Cited

U.S. PATENT DOCUMENTS 4,386,816 6/1983 Frear et al. ..... 439/595

4,921,448 5/1990 Endo et al. ..... 439/592

*Primary Examiner*—Gary F. Paumen

*Assistant Examiner*—Yong Ki Kim

*Attorney, Agent, or Firm*—Laff, Whitesel, Conte & Saret, Ltd.

[57] ABSTRACT

An electric low-voltage connecting terminal (1) is provided, in particular for luminous signallers, which comprises a socket connector (2) having a tubular coupling portion (2*a*), a plug connector (3) having a reed-like coupling portion (3*a*) to be fitted into the tubular coupling portion (2*a*) for establishing an electrical contact over an area substantially equal to the surface of the opposite side edges (3*b*) of the reed (3), and snap-engagement elements (9*a*) adapted to prevent slipping off between said socket (2) and plug (3) connectors.

6 Claims, 1 Drawing Sheet

FIG. 2
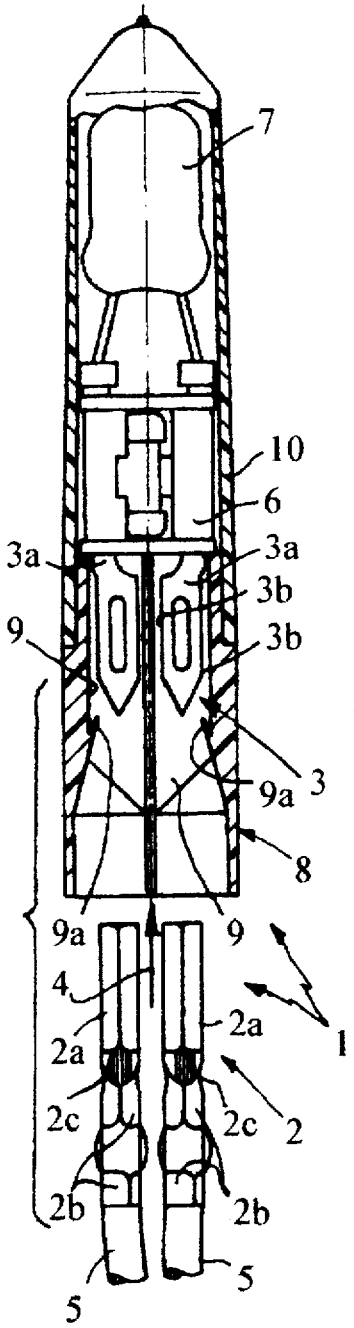
FIG. 1
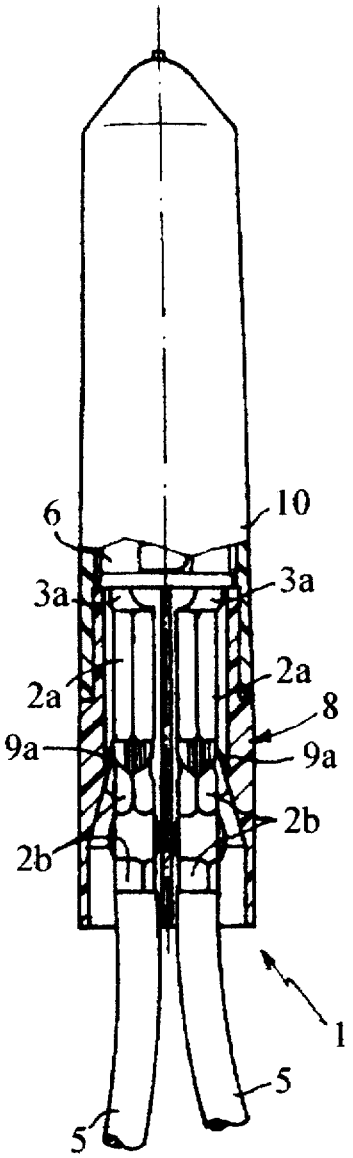
FIG. 3
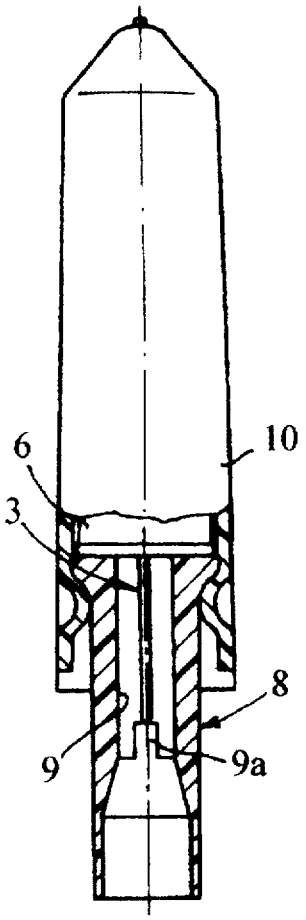
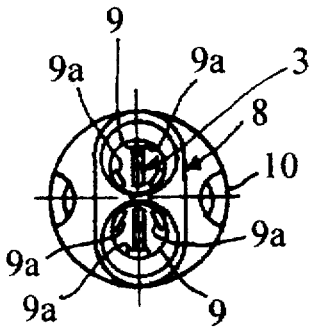
FIG. 4

ELECTRIC LOW-VOLTAGE CONNECTING TERMINAL, IN PARTICULAR FOR LUMINOUS SIGNALLERS

BACKGROUND OF THE INVENTION

1. Field of the Invention

The present invention relates to an electric low-voltage connecting terminal, in particular for luminous signallers, of the type comprising a socket connector and a plug connector adapted to be mutually coupled for fitting along an insertion line.

It is known that electric connecting terminals for low-voltage user means, such as luminous signallers employed in household electrical appliances, generally consist of connectors or cable terminals comprising a female or socket connector and a male or plug connector adapted to be coupled by forced fitting along an insertion direction defined by the sliding and mutually-contacting surfaces of these connectors.

2. Prior Art

In the known art it is generally provided that the socket and plug connectors should have a mutually conforming shape so as to give rise to a wide contact surface enabling development of a strong friction adapted to counteract slipping off of the connectors.

In order to achieve this aim, known connecting terminals are for example comprised of a socket connector that, in addition to being provided with a portion for clinching to an electric wire, also has a tube-shaped coupling portion of a substantially circular section, and of a plug connector which, in addition to being obviously provided with a portion for attachment to the electric conductor to which it is to be connected, also has a substantially cylindrical mating portion capable of positioning almost completely in contact with the inner surface of the tube-shaped coupling portion.

In another known embodiment, the plug connector comprises a reed-like, that is flat, portion adapted to be forcedly fitted into a socket connector in turn comprising a coupling portion which is substantially flattened too, so that both the main faces of the above reed-like portion can be in contact with the inner surface of the coupling portion.

The known art briefly described above however has severe limits and drawbacks.

Actually, the wide contact surface between the socket and plug connectors ensuring setting up of a high friction force, of approximately 8 kg for example, capable of validly counteracting the accidental slipping off of the connecting terminal, also necessarily gives rise to the occurrence, during the assembling step of electric circuits in which these connectors are employed, of a fitting force of same intensity as the friction force; said strong fitting force increases the fatigue of the workmen assigned to this production step and also reduces the operating speed for wiring and therefore the overall productivity of all assembling operations.

Attempts have been made to overcome the above described drawback by carrying out the coupling operation between the connectors directly during the manufacturing step of same and by associating with said connectors the electric wires considered as appropriate to the subsequent uses with the enterprises designed to carry out assembling of the appliances where connectors are to be installed. However this procedure has proved to be unsatisfactory from a practical and economical point of view. In fact, not only the storing volume of the individual connecting terminals is increased since more or less extended portions of electric wire are connected thereto, but also said wire portions often are not appropriate for the intended uses in that they are too long or too short, which will involve non negligible economical damages.

SUMMARY OF THE INVENTION

Under this situation the technical task underlying the present invention is to provide an electric low-voltage connecting terminal, in particular for luminous signallers, capable of substantially obviating the above mentioned drawbacks.

Within the scope of this technical task it is an important object of the present invention to devise an electric connecting terminal capable of reducing to an important degree the force necessary for coupling of the connectors forming it, while at the same time developing a high resistance to the slipping off actions between said connectors.

Another object of the invention is to achieve a further miniaturization of the connecting terminals as compared with those of the known art.

A still further and important object of the present invention is to devise a connecting terminal ensuring a high safety in the electrical connections at very reduced costs in both the production and assembling steps.

The technical task mentioned and the objects specified are substantially achieved by an electric low-voltage connecting terminal in which said socket connector has a tubular coupling portion and said plug connector has reed-like coupling portion to be fitted by sliding along said insertion direction into said tubular coupling portion in a manner adapted to establish an electrical contact with said tubular portion over an area substantially corresponding to the surface of the opposite side edges of said reed, and in which said terminal comprises locking means adapted to prevent said plug connector from slipping off said socket connector.

BRIEF DESCRIPTION OF THE DRAWINGS

The description of a preferred but not exclusive embodiment of an electric low-voltage terminal in accordance with the invention is now given by way of non-limiting example, with the aid of the accompanying drawings, in which:

FIG. 1 is a longitudinal sectional view of the connecting terminal in a fitting position applied to a luminous signaller and to the related electric power wires;

FIG. 2 shows the terminal of FIG. 1 before fitting of the respective connectors;

FIG. 3 is a longitudinal sectional view of the terminal shown in FIG. 2 not associated with the socket connectors and rotated through 90°;

FIG. 4 is a bottom view of the terminal shown in FIG. 3.

DESCRIPTION OF THE PREFERRED EMBODIMENT

Referring to the drawings, the connecting terminal according to the invention is generally identified by reference numeral 1.

It comprises a socket or female connector 2 and a plug or male connector 3 adapted to be coupled with each other by fitting along an insertion direction 4 coinciding with the longitudinal direction of major extension of both connectors.

Terminal 1 is adapted for low-voltage uses and in the accompanying drawings a two-pole connection for a signal lamp or luminous signaller 7 is shown, in which a pair of connectors of each type 2, 3 is utilized.

Each socket connector 2 has a tubular coupling portion 2*a* obtained by folding a flat thin plate, and a clinching portion 2*b* for fixing to an electric wire 5.

Each plug connector 3 is housed within a base casing 6 of an insulating material and has a reed-like coupling portion 3*a* to which a user means 7 (a luminous signalling element for example) power supplied by the plug connector itself, is connected.

The reed-like coupling portion 3*a* has opposite side edges 3*b* defining the insertion direction 4 and suitably spaced apart from each other so as to cause a slightly-forced fitting of the reed-like coupling portion into the tubular coupling portion 2*a*. More particularly, the electrical contact on the inner surface of said tubular portion substantially corresponds to an area equal to the surfaces of the opposite side edges 3*b* of the plug connector 3. This contact area, while being quite appropriate to establish the electrical connection between the socket and plug connectors, is of a reduced value with respect to the contact area present in connecting terminals of known type and consequently gives rise to a reduced friction when one connector is fitted into the other, so that a force usually not overcoming 1 kg is required from the person assigned to the assembling of said connectors.

In order to inhibit slipping off between the socket and plug connectors, provision is made for locking means 8 defined by a hollow locking body, obtained by plastics moulding, which is fixed relative to the plug connector 3 and adapted to house at least the tubular coupling portion 2*a* of one socket connector 2.

More particularly, the locking body 8 comprises two sleeve-shaped seatings 9 disposed in side by side relationship, into which an equal number of tubular coupling portions 2*a* of a pair of socket connectors 2 can be fitted, along the insertion direction 4.

Provided within each seating 9 are three snap-engagement elements 9*a*, defined by hook-shaped inner expansions and spaced apart 120° from each other in a plane transverse to the insertion direction 4. The snap-engagement elements 9*a* are adapted to come into contact with the rear edge 2*c* of the tubular coupling portion 2*a* when the latter has been completely fitted into the respective seating 9.

Since this rear edge 2*c* extends over an arc of a circumference at least as wide as 180°, at least one of the snap-engagement elements 9*a* abuts against said rear edge 2*c* thereby forming a locking abutment capable of withstanding slipping-off stresses of about 7/10 kg.

Seatings 9 are also made integral, by thermoforming or any other undetachable junction technique, with a sheath portion 10 so as to define one single body therewith. The sheath portion 10, in turn, houses the base casing 6 with which two plug connectors and the user means 7 are associated.

Practically, the connecting terminal of the invention, for a two-pole user means, appears as formed of one element inside which one user means and two plug connectors 3 are installed, which plug connectors are adapted to be connected with a pair of socket connectors to be fitted during the wiring step into the respective housings 9 of the locking body 8.

The invention achieves important advantages.

In fact, since the connecting terminal of the invention requires a reduced force for carrying out coupling between the plug and socket connectors, it can be supplied to users with said connectors still to be fitted. In this manner, the electric wire or conductors leading off to the socket connectors can be selected, depending on requirements, directly during the assembling step, which will avoid waste of material and rather high storing costs.

It is pointed out, above all, that the operators assigned to wiring are required of a very reduced effort, although the electrical connections thus made are not subjected to accidental slipping off and therefore are very reliable and safe. The production rate for assembling the electric circuits to which this terminals are connected is therefore increased.

It will be finally recognized that the locking means preventing slipping off of the connectors are very simple and do not involve high manufacturing costs. As a result the cost of the whole connecting terminal will be correspondently reduced.

What is claimed is:

1. An electric luminous signaller low-voltage connecting terminal (1), comprising a socket connector (2) and a plug connector (3) constructed to be mutually coupled to provide low voltage electrical contact, said socket connector (2) has a tubular coupling portion (2*a*), said plug connector (3) has a reed-like coupling portion (3*a*), said reed-like coupling portion having two opposite side edges spaced apart from each other, said tubular coupling portion being sized to provide electric contact between substantially only said two opposite side edges of said reed-like coupling portion and inner walls of said tubular coupling portion when said socket connector and said plug connector are coupled, and locking means (8) to releasably lock said plug connector (3) to said socket connector (2).

2. The terminal as claimed in claim 1, wherein said locking means (8) comprises a hollow locking body (8) integral with at least one said plug connector (3) and adapted to house at least said tubular coupling portion (2*a*) of said socket connector (2), and wherein said locking body (8) has at least one snap-engagement element (9*a*) active on said tubular coupling portion when fitting has been completed.

3. The terminal as claimed in claim 2, wherein said snap-engagement element (9*a*) is hook-shaped and is adapted to come into contact with a rear edge (2*c*) of said tubular coupling portion (2*a*).

4. The terminal as claimed in claim 3, wherein provision is made for three of said snap-engagement elements (9*a*) which are disposed spaced apart 120° from each other in a plane transverse to said insertion direction (4).

5. The terminal is claimed in claim 2, wherein said locking body (8) comprises:

at least one sleeve-shaped seating (9) provided with at least one said snap-engagement element (9*a*), and a sheath portion (10) housing a base casing (6) at which it least one said plug connector (3) and at least one user means (7) power supplied by said plug connector (3) terminate, and wherein said housing (9) and sheath portion (10) are integral with each other so as to define one single body and to lock said base casing (6) and plug connector (3) within the sheath portion itself (10).

6. The terminal as claimed in claim 5, wherein said locking body (8) comprises two sleeve-shaped seatings (9) disposed side by side and adapted to be fitted onto to respective tubular coupling portions (2*a*) of two socket connectors (2).

* * * * *